US007690867B2

(12) United States Patent
Meyer

(10) Patent No.: US 7,690,867 B2
(45) Date of Patent: Apr. 6, 2010

(54) CENTER BEAM CONNECTION ASSEMBLY FOR TEMPORARY SHORING

(76) Inventor: John W. Meyer, 9323 Fourth St., Lanham, MD (US) 20706

( * ) Notice: Subject to any disclaimer, the term of this patent is extended or adjusted under 35 U.S.C. 154(b) by 32 days.

(21) Appl. No.: 11/837,593

(22) Filed: Aug. 13, 2007

(65) Prior Publication Data

US 2009/0047074 A1 Feb. 19, 2009

(51) Int. Cl.
*E02D 17/04* (2006.01)

(52) U.S. Cl. ..... 405/283; 405/272; 405/282

(58) Field of Classification Search ..... 405/272, 405/276, 277, 282, 283; 403/169–178, 217–219, 403/308, 335–337
See application file for complete search history.

(56) References Cited

U.S. PATENT DOCUMENTS 3,159,978 A 12/1964 De Lillo
3,393,521 A 7/1968 Cammisa
3,584,465 A 6/1971 Iioll
3,710,578 A 1/1973 Inoue
4,453,863 A * 6/1984 Sutton et al. ..... 405/282
4,569,451 A 2/1986 Parrott et al.
6,984,092 B1 1/2006 Meyer et al.

FOREIGN PATENT DOCUMENTS

JP 57029732 * 2/1982

* cited by examiner

*Primary Examiner*—David J Bagnell
*Assistant Examiner*—Benjamin Fiorello
(74) *Attorney, Agent, or Firm*—Diederiks & Whitelaw, PLC

(57) ABSTRACT

A center beam connection assembly for temporary shoring includes a pair of end-caps adapted to fit over respective ends of a center shoring beam. Arms extending from each end-cap engage a web of a main shoring beam in a excavation site shoring system. The end-caps may be used alone, or in combination with reinforcing and spacer bars. Reinforcing bars include first and second hooks adapted to connect to a main shoring beam and a center shoring beam, respectively. When utilized, each spacer bar is connected to at least one tab on an end-cap and at least one tab on a reinforcing bar via connecting pins. In this manner, one or more center shoring beams can span an excavation hole to provide removable, reusable and temporary support for a shoring system.

5 Claims, 4 Drawing Sheets

CENTER BEAM CONNECTION ASSEMBLY FOR TEMPORARY SHORING

BACKGROUND OF THE INVENTION

1. Field of the invention

The present invention is generally directed to a system for temporarily shoring up an excavation site. More particularly the invention is directed to a center beam connection assembly for an excavation site shoring system.

2. Description of the Prior Art

In a typical excavation site, workers are exposed to numerous hazards. The most common hazard is having the walls of the excavation site cave in on the workers, thus causing serious injury. Often due to soil conditions and wetness, the sides of a construction site will simply collapse. Water is a particularly dangerous hazard because it is so heavy and can destroy shoring, which has not been properly reinforced. Realizing this problem the government, at both the federal and state level, has set up specific requirements for all excavation sites to avoid the problem of cave-ins. For example, the United States Department of Labor and, more specifically, the Occupational Safety and Health Administration (OSHA) requires that excavation sites be prepared with some type of shoring. Additionally, many companies are now aware of the problems involved in a typical excavation site and have developed internal policies requiring shoring for any excavations they contract to have completed.

A good example of a typical excavation project is found in replacing underground storage tanks for a gasoline station. Typically, in such an operation, sheet piling is pounded into the ground in a generally rectangular configuration around the work site. The piling has to be driven extremely deeply into the ground and arranged to provide sufficient support against potential cave-ins. Typically the sheet piling has to be driven so deep that half its total height remains underground after the excavation has been completed. Use of such large amounts of material is quite expensive. After the sheet piling has been installed, the workmen then remove the dirt and fill material from within the rectangular shoring. During the work of removing the old storage tanks and replacing them with new storage tanks, the shoring provides protection to the workmen against potential cave-ins. Once the storage tank replacement operation has been completed, the shoring can either be completely removed or simply cut down to a safe distance below ground and then left in place. Such a method of shoring an excavation site is extremely expensive.

One solution to the problem is set forth in U.S. Pat. No. 6,984,092, which discloses a corner connection for temporary shoring providing a connector for interconnecting various beams used to reinforce shoring. See the prior art depiction set forth in FIG. 1. This system utilizes connecting members to secure I-beams together at the corners of an excavation site. A reinforcing assembly helps support the system and includes spacer bars with tabs that connect respective connecting members to a reinforcing bar. Although an improvement over prior shoring arrangements, further reinforcement would be needed should the shoring system of the '092 patent be utilized in a large excavation site.

The following invention addresses the problem of large excavation sites by provided an improved temporary shoring arrangement including a removable center shoring beam system.

SUMMARY OF THE INVENTION

A connection assembly used to secure a center shoring beam to the main I-beams of a temporary shoring system is provided that allows a removable shoring system to be utilized with large-scale excavation sites. The connection assembly generally comprises first and second end-caps adapted to receive respective ends of a center reinforcing beam. Arms located on each of the first and second end-caps are utilized to removably connect the end-caps to opposing main shoring beams. Additionally, tabs extending from each of the first and second end-caps include apertures therein adapted to receive connecting pins. The end-caps may be utilized on their own, or in combination with reinforcing bars and spacer bars. Reinforcing bars include hooks and tabs with apertures therein placed at either end of the reinforcing bar. In use, one hook connects with the web of a main shoring beam and one hook connects with a web of the center shoring beam. Spacer bars having apertures at either end can be utilized to secure the reinforcing bars to an associated end-cap. More specifically, each end of a spacer bar is connected via a connecting pin to either the tab of an end-cap or the tab of a reinforcing bar. Advantageously, the connection assembly of the present invention can be utilized with prior art shoring systems and provides temporary, removable and reusable reinforcement for large excavation sites.

Additional objects, features and advantages of the present invention will more readily be apparent from the following description of the preferred embodiment thereof, when taken in connection with the drawings wherein like reference numerals refer to correspond parts in the several views.

DETAILED DESCRIPTION OF THE PREFERRED EMBODIMENTS

Figure 1:
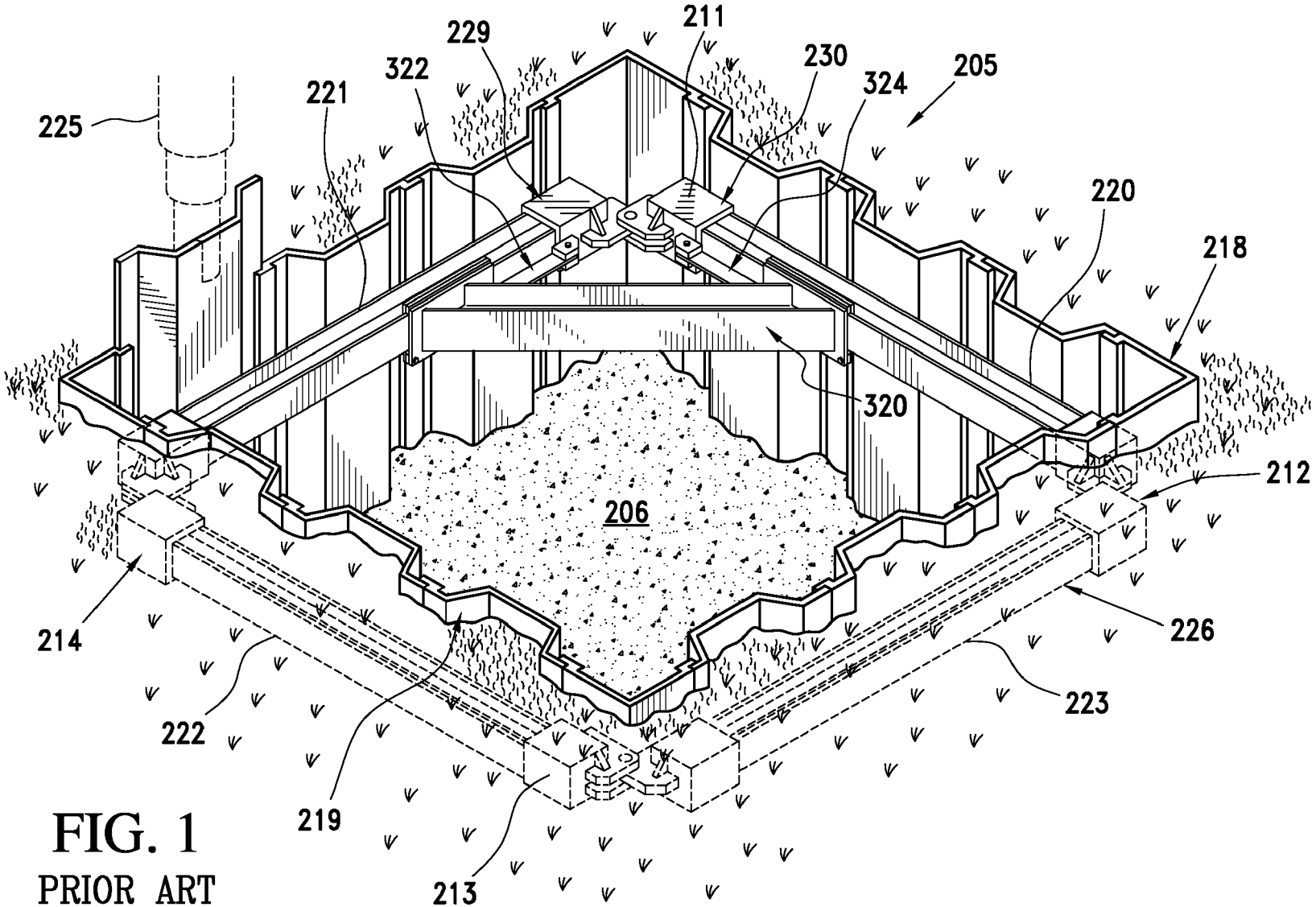
FIG. 1 PRIOR ART
FIG. 1 is a perspective view of a prior art temporary shoring arrangement.

Referring now to FIG. 1 there is shown a typical excavation site 205 incorporating a temporary shoring system as set forth in U.S. Pat. No. 6,984,092. Excavation site 205 includes an excavation hole 206 incorporating corner connections 211-214 for temporary shoring 218. Temporary shoring 218 comprises three major elements: interlocking sheet piling 219, I-beams (wales) or shoring beams 220-223 and corner connections 211-214, each connection including two connectors for the I-beams 220-223. Interlocking sheet piling 219 is placed along the walls of the excavation hole 206. Typically, a driving machine 225 is used to drive each section of piling 219 to a desired depth within the ground.

A reinforcing structure 226 is provided behind the interlocking sheet piling 219. The reinforcing structure 226 includes the set of I-beams 220-223 that interact with the set of corner connections 211-214. Each corner connection includes a couple of corner connectors. For example, corner connection 211 includes a first shoring beam connector 229 and a second shoring beam connector 230. Additionally, a reinforcing assembly is provided, which includes a reinforcing bar 320, a first spacer bar 322 attached to the reinforcing bar 320 and first shoring beam connector 229, and a second spacer bar 324 attached to the reinforcing bar 320 and second shoring beam connector 230.

Figure 2:
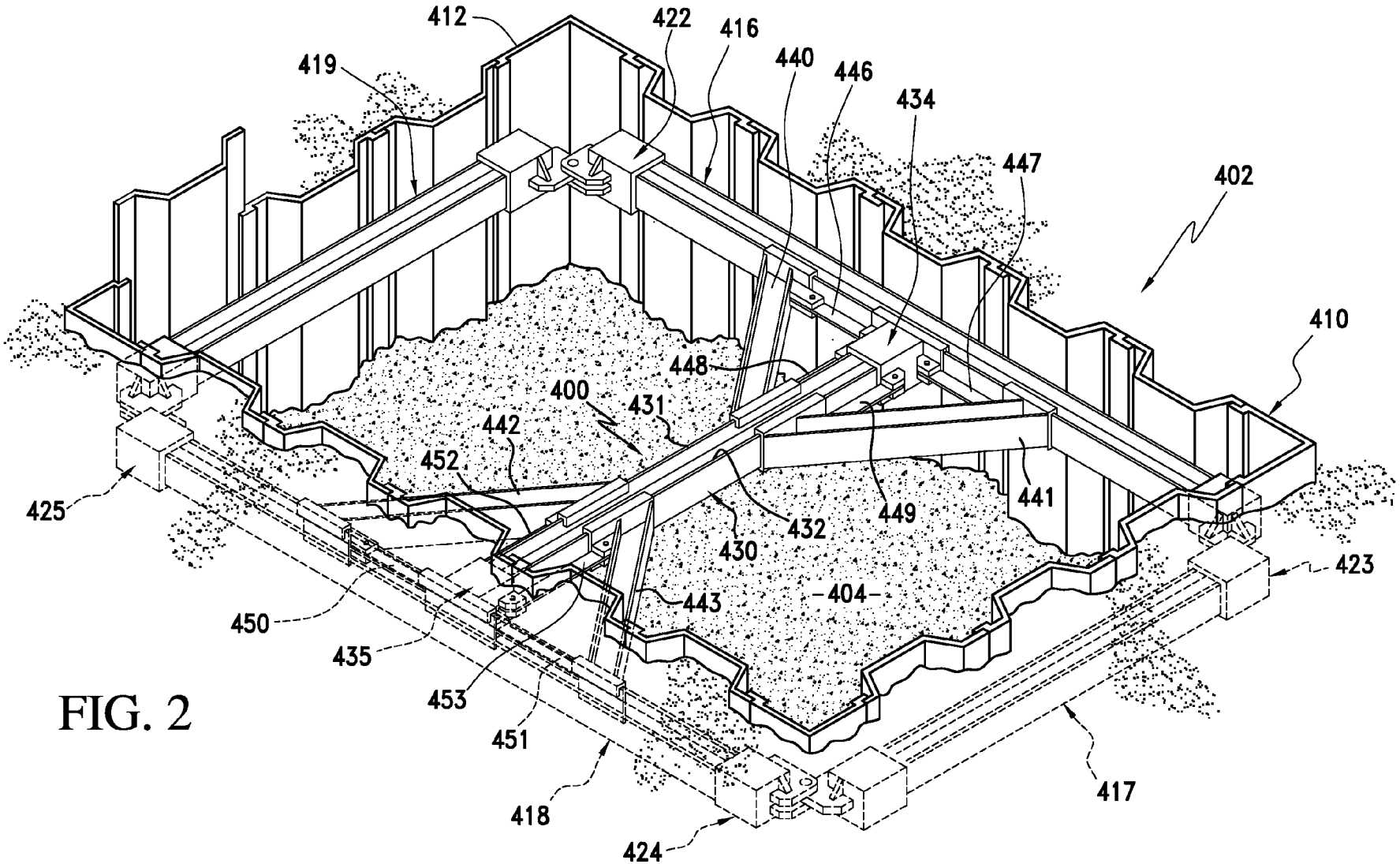
FIG. 2 is a prospective view of a center beam connection assembly of the present invention.

Turning now to FIG. 2, a center beam connection assembly 400 of the present invention will now be discussed. An excavation site 402 having a hole 404 includes a temporary shoring system 410 comprising: interlocking sheet piling 412, main shoring beams 416-419 and corner connections 422-425. Connection assembly 400 spans hole 404, providing additional support to shoring system 410. In general, connection assembly 400 comprises a center shoring beam 430 having first and second webs 431, 432; first and second end-caps 434, 435; reinforcing bars 440-443; and spacer bars 446-453.

Figure 3:
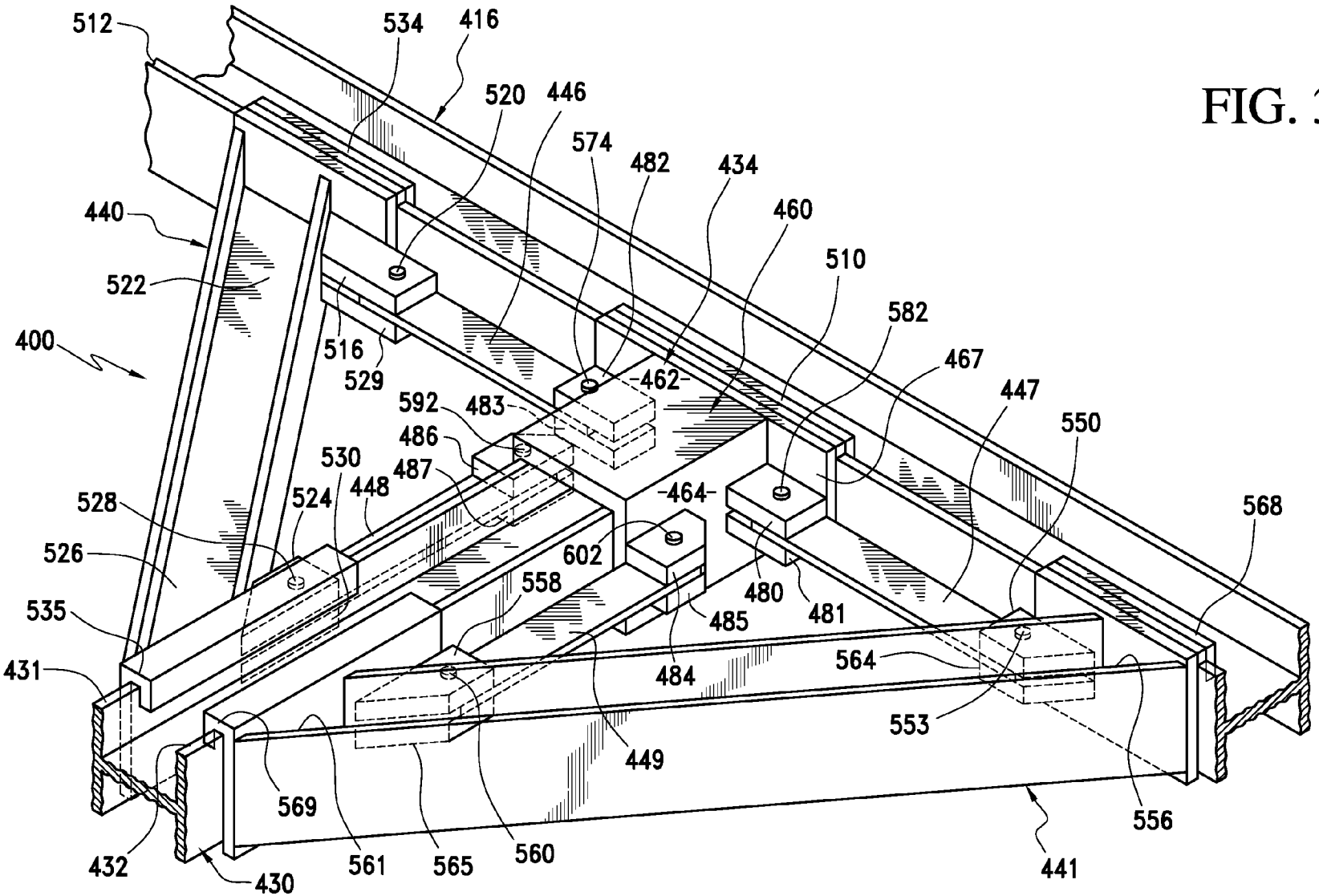
FIG. 3 is a partial perspective view of the center beam connection assembly of FIG. 2, showing one end of the connection assembly.
Figure 4:
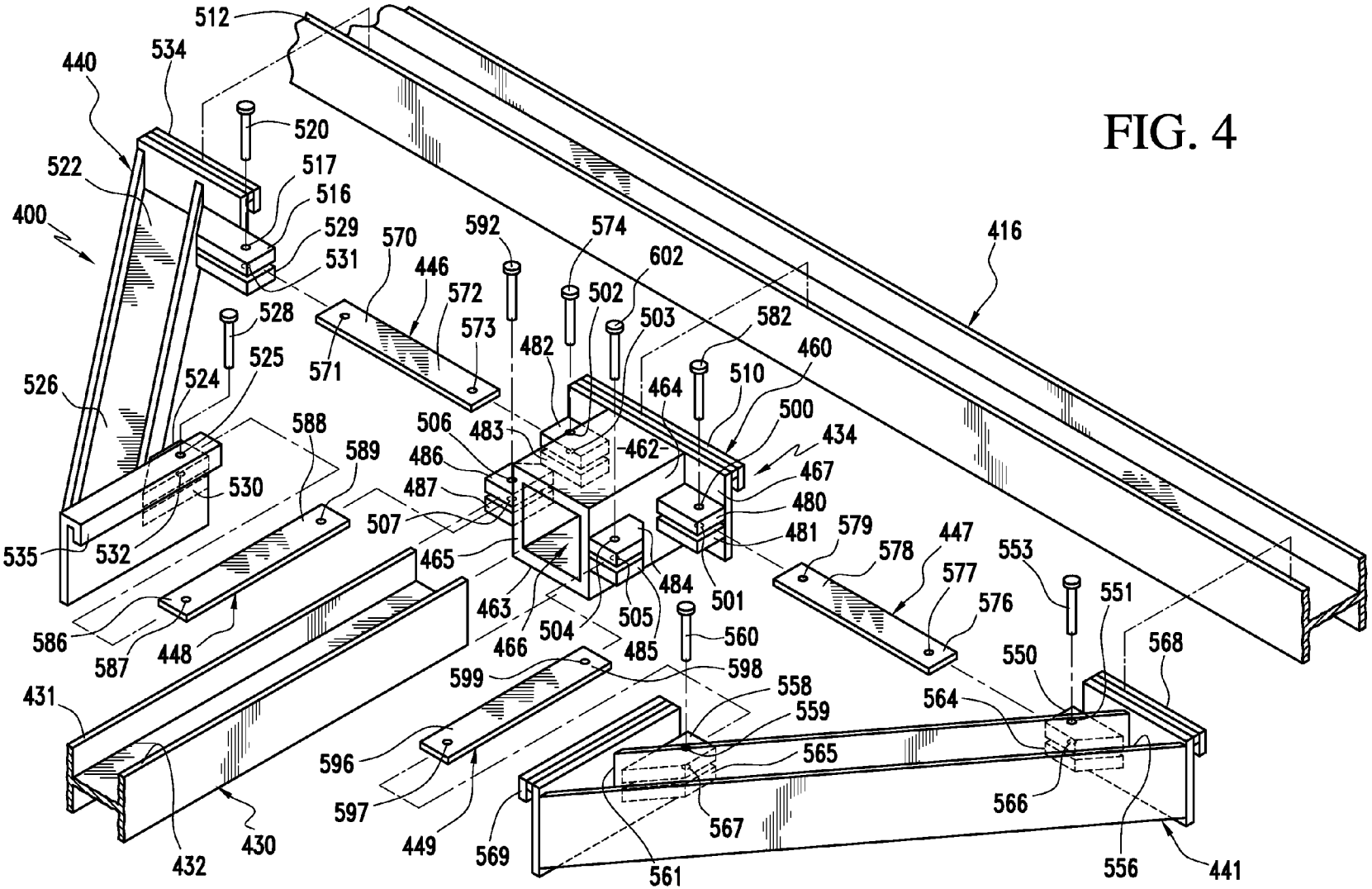
FIG. 4 is an exploded view of the assembly shown in FIG. 2.

With reference to FIGS. 3 and 4, a close up view of first end-cap 434 will now be discussed. First end-cap 434 includes a box-like main body portion 460 comprising five panels to form an open box shape. Opposing top 462 and bottom 463 panels are connected with opposing side panels 464, 465 to form the square or rectangular opening 466 designed to receive center shoring beam 430. An end panel 467 also preferably square or rectangular in shape closes off one end of main body 460. Each of panels 462-466 are made from heavy steel and are welded together to form main body 460. Side panels 464 and 465 each include a first pair of tabs 480, 481 and 482, 483, respectively, which are welded both to the respective side panels 464, 465 and to end panel 467. Furthermore, each of side panels 464 and 465 include a second pair of tabs 484, 485 and 486, 487, respectively. Each of tabs 480-489 is a flat plate-like member that extends laterally from main body portion 460 of end cap 434 and includes respective apertures 500-507. Tabs 480-489 are preferably made of a similar or the same material as main body portion 460 and are preferably welded to main body portion 460. While other methods may be utilized to attach tabs 480-489 to main body portion 460, it is important that each tab be able to withstand the tremendous hydraulic pressures that may be transmitted by main shoring beam 416 if sheet piling 412 starts to buckle. It should be understood that, while pairs of tabs are shown, main body portion 460 may include only single tabs extending there from, provided that each tab can withstand appropriate hydraulic pressure. Additionally, a hook or arm 510 is attached to end panel 467 via welding. Alternatively, arm 510 may be integrally formed with end panel 466. Arm 510 is adapted to secure end-cap 434, and its associated center shoring beam 430, to a main shoring beam, such as 416. More specifically, arm 510 secures over a web 512 on main shoring beam 416.

As depicted in FIG. 2, center shoring beam 430 is connected to main shoring beams 416 and 418 via respective end-caps 434 and 435. This center shoring beam connection may be used alone, or with the addition of reinforcing bars 440-443, or reinforcing bars 440-443 in combination with spacer bars 446-453. As seen more clearly in FIGS. 3-4, reinforcing bar 440 is formed of a standard I-beam having its ends cut at 45 degrees so as to connect to both a main shoring beam 416 and center shoring beam 430. Reinforcing bar 440 further comprises a first tab 516 with an aperture 517 adapted to receive a connecting pin 520 located at a first end 522 and a second tab 524 with an aperture 525 located at a second end 526 and adapted to receive a connecting pin 528. Optionally, additional tabs 529 and 530 including respective apertures 531, 532, may be connected to respective ends 522, 526 in order to provide additional support. Reinforcing bar 440 further includes hooks 534, 535 attached to each end 522, 526, wherein hooks 534 and 535 are adapted to be connected to main shoring beam 416 and center shoring beam 430, respectively. More specifically, hooks 534 and 535 mate with web 512 of main shoring beam 416 and first web 431 of center shoring beam 430, respectively. Like reinforcing bar 440, reinforcing bar 441 is formed of a standard I-beam having its ends cut at 45 degrees so as to connect to both a main shoring beam 416 and center shoring beam 430. Reinforcing bar 441 comprises a first tab 550 with an aperture 551 adapted to receive a connecting pin 553 located at a first end 556 and a second tab 558 with an aperture 559 for receiving a connecting pin 560 located at a second end 561. Optionally, additional tabs 564 and 565 including respective apertures 566, 567 may be connected to respective ends 556, 560 in order to provide additional support. Reinforcing bar 441 further includes hooks 568, 569 attached to each end 556, 561 wherein hooks 568 and 569 are adapted to mate with the top web 512 of main shoring beam 416 and first web 431 of center shoring beam 430, respectively.

As previously mentioned, reinforcing bars 440-443 may be utilized alone, or in combination, with spacer bars 446-453. First spacer bar 446 includes a first end 570 with an aperture 571 located therein adapted to receive connecting pin 520, and a second end 572 with an aperture 573 located therein adapted to receive a connecting pin 574. In use, respective ends 570, 572 of spacer bar 446 fit between tabs 482, 483 of end-cap 434 and tabs 516 and 529 of reinforcing bar 440; with pin 520 being inserted through aperture 571 of spacer bar 446 and apertures 517, 531 of tabs 516, 529; and pin 574 being inserted through aperture 573 of spacer bar 446 and apertures 502, 503 of tabs 482, 483. Likewise, second spacer bar 447 includes a first end 576 with an aperture 577 located therein adapted to receive connecting pin 553, and a second end 578 with an aperture 579 located therein adapted to receive a connecting pin 582. In use, respective ends 576, 578 of spacer bar 447 fit between tabs 480, 481 of end-cap 434 and tabs 550 and 564 of reinforcing bar 441; with pin 553 being inserted through aperture 577 of spacer bar 447 and apertures 551, 566 of tabs 550, 564; and pin 582 being inserted through aperture 579 of spacer bar 447 and apertures 500, 501 of tabs 480, 481.

The third and fourth spacer bars 448, 449 are also utilized to connect first end-cap 434 to reinforcing bars 440, 441. More specifically, third spacer bar 448 includes a first end 586 with an aperture 587 located therein adapted to receive connecting pin 528, and a second end 588 with an aperture 589 located therein adapted to receive a connecting pin 592. In use, respective ends 586, 588 of spacer bar 448 fit between tabs 524, 530 of reinforcing bar 440 and tabs 486, 487 of end-cap 434; with pin 528 being inserted through aperture 587 of spacer bar 448 and apertures 525, 532 of tabs 524, 530; and pin 592 being inserted through aperture 589 of spacer bar 448 and apertures 506, 507 of tabs 486, 487. Likewise, fourth spacer bar 449 includes a first end 596 with an aperture 597 located therein adapted to receive connecting pin 560, and a second end 598 with an aperture 599 located therein adapted to receive a connecting pin 602. In use, respective ends 596, 598 of spacer bar 449 fit between tabs 558 and 565 of reinforcing bar 441 and tabs 484, 485 of end-cap 434; with pin 560 being inserted through aperture 597 of spacer bar 449 and apertures 559, 567 of tabs 558, 565; and pin 602 being inserted through aperture 599 of spacer bar 449 and apertures 504, 505 of tabs 484, 485.

At this point it should be understood that, just as one end of center shoring beam 430 is supported by end-cap 434, the other end of center shoring beam 430 is supported by end-cap 435 is the same manner. More specifically, with respect to structure, end-cap 435 corresponds to end-cap 434, reinforcing beams 440 and 441 correspond to reinforcing beams 442, 443, and spacer bars 446-449 correspond to spacer bars 450-453, with various connecting pins utilized to maintain the assembly connected.

In operation, connection assembly 400 is intended to be utilized with a shoring system 410. Initially, end-caps 434, 435 are placed on respective ends of center shoring beam 430. Importantly, end-caps 434, 435 are adapted to simply slip over the ends of center shoring beam 430 and are not required to be welded thereto. As depicted in FIG. 2, once end-caps are connected to center shoring beam 430, arm 510 of end-cap 434 is hooked over web 412 of main shoring beam 416, while an arm 610 of end-cap 435 is hooked over a web 612 of main shoring beam 418. This provides a quick, yet secure method of retaining a center shoring beam in the proper location in a shoring system.

If additional support is desired, reinforcing bar 440 is placed such that hooks 534, 535 connect to web 412 of main shoring beam 416 and web 431 of center shoring beam 430, respectively; and reinforcing bar 441 is placed such that hooks 568, 569 connect to web 412 of main shoring beam 416 and web 432 of center shoring beam 430, respectively. Corresponding structure on reinforcing bars 442 and 443 connect them to center shoring beam 430 and main shoring beam 418 in a like manner. Further support can be provided by connecting spacer bars 446-453 to shoring system 410 in the manner outlined above with respect to reinforcing bars 446-449.

Although described with respect to preferred embodiments of the invention, it should be understood that various changes and/or modifications could be made to the invention without departing from the spirit thereof. For example, although pairs of tabs are shown extending from end-caps 434, 435 and reinforcing beams 440-443, it should be understood that single tabs may optionally be utilized. Additionally, although only one center shoring beam is shown, it should be understood that large excavations sites may benefit from multiple center shoring beams utilizing the connection assembly of the present invention. Therefore, the specific embodiments disclosed herein are to be considered illustrative and not restrictive. Instead, the invention is only intended to be limited by the scope of the following claims.

I claim:

1. A center beam connection assembly for a shoring system including first and second main shoring beams, the assembly comprising:

a center shoring beam including a first end and a second end;

a first end-cap including an arm adapted to hook over a web of the first main shoring beam to selectively connect the first end-cap to the first main shoring beam, and a hollow main body portion formed along a first longitudinal axis and having an opening situated at one longitudinal end of said main body portion, wherein said main body portion is adapted to slidably receive, through said opening, the first end of the center shoring beam; and a second end-cap including an arm adapted to hook over a web of the second main shoring beam to selectively connect the second end-cap to the second main shoring beam, and a hollow main body portion formed along a first longitudinal axis and having an opening situated at one longitudinal end of said main body portion, wherein said main body portion is adapted to slidably receive, through said opening, the second end of the center shoring beam.

2. The center beam connection assembly of claim 1, further comprising:

first and second webs extending longitudinally along the center shoring beam;

a first reinforcing bar having a first end with a first hook and a second end with a second hook, said first hook adapted to mate with the web of the first main shoring beam and said second hook adapted to mate with the first xveb of the center shoring beam; and a second reinforcing bar having a first end with a first hook and a second end with a second hook, said first hook adapted to mate with the web of the first main shoring beam and said second hook adapted to mate with the second web of the center shoring beam.

3. The center beam connection assembly of claim 2, further comprising:

a first spacer bar having a first end adapted to attach to a first tab extending from the main body portion of the end-cap and a second end adapted to attach to a first tab extending from the first reinforcing bar; and a second spacer bar having a first end adapted to attach to a second tab extending from the main body portion of the end-cap and a second end adapted to attach to a first tab extending from the second reinforcing bar.

4. The center beam connection assembly of claim 3, further comprising:

a third spacer bar having a first end adapted to attach to a third tab extending from the main body portion of the end-cap and a second end adapted to attach to a second tab extending from the first reinforcing bar; and a fourth spacer bar having a first end adapted to attach to a fourth tab extending from the main body portion of the end-cap and a second end adapted to attach to a second tab extending from the second reinforcing bar.

5. The center beam connection assembly of claim 1, wherein the hollow main body portion of the end cap is in the form of a rectangle defined by a top panel, a bottom panel and opposing side panels; and the hollow main body portion of the second end cap is in the form of a rectangle defined by a top panel, a bottom panel and opposing side panels.

* * * * *